US007675495B2

(12) United States Patent
Rao et al.

(10) Patent No.: US 7,675,495 B2
(45) Date of Patent: Mar. 9, 2010

(54) TFT-LCD CAPABLE OF REPAIRING DISCONTINUOUS LINES

(75) Inventors: Yong-Nien Rao, Hsin Chu (TW); Shih-Tzung Chou, Hsin Chu County (TW); Chun-Lin Hou, Tou Liao (TW)

(73) Assignee: Sunplus Technology Co., Ltd., Hsin-Chu (TW)

( * ) Notice: Subject to any disclaimer, the term of this patent is extended or adjusted under 35 U.S.C. 154(b) by 1136 days.

(21) Appl. No.: 11/287,392

(22) Filed: Nov. 28, 2005

(65) Prior Publication Data

US 2006/0125754 A1 Jun. 15, 2006

(30) Foreign Application Priority Data

Dec. 1, 2004 (TW) ..... 93137036 A

(51) Int. Cl.
*G09G 3/36* (2006.01)

(52) U.S. Cl. ..... 345/87; 93/94

(58) Field of Classification Search ..... 345/55, 345/87–100, 201–205, 211–214; 349/54, 349/192

See application file for complete search history.

(56) References Cited

U.S. PATENT DOCUMENTS

| | | | | |
|---|---|---|---|---|
| 6,525,705 | B1 * | 2/2003 | Ishii et al. | 345/87 |
| 6,618,101 | B1 * | 9/2003 | Kim et al. | 349/54 |
| 6,639,634 | B1 * | 10/2003 | Zhang et al. | 349/54 |
| 6,943,374 | B1 * | 9/2005 | Park | 257/72 |
| 7,609,246 | B2 * | 10/2009 | Hsu et al. | 345/93 |
| 2005/0110738 | A1 * | 5/2005 | Kim et al. | 345/100 |

* cited by examiner

*Primary Examiner*—Richard Hjerpe
*Assistant Examiner*—Mansour M Said
(74) *Attorney, Agent, or Firm*—Muncy, Geissler, Olds & Lowe, PLLC

(57) ABSTRACT

A TFT-LCD capable of repairing discontinuous lines includes a repairing circuit, which includes a plurality of repairing OP amplifiers and a high-impedance detecting unit. The high-impedance detecting unit detects states of input terminals of the OP amplifiers. The high-impedance detecting unit enables a control signal to enable the OP amplifier when the input terminal is not at floating state. The high-impedance detecting unit disables the control signal to disable the OP amplifier when the input terminal is at floating state, so that no output competition between the OP amplifiers is generated.

20 Claims, 4 Drawing Sheets

TFT-LCD CAPABLE OF REPAIRING DISCONTINUOUS LINES

This application claims the benefit of the filing date of Taiwan Application Ser. No. 093137036, filed on Dec. 1, 2004, the content of which is incorporated herein by reference.

BACKGROUND OF THE INVENTION

1. Field of the Invention

The invention relates to a TFT-LCD capable of repairing discontinuous lines and a high-impedance detecting unit.

2. Description of the Related Art

LCDs (Liquid Crystal Displays) are a mainstream of portable displays due to small size and light weight. In addition, the great cost-down of the LCD has made the LCD become a medium/small scale display, which has the maximum potential in the market. Among the LCDs, the TFT-LCD (Thin Film Transistor Liquid Crystal Display) is the most popular product.

In a typical TFT-LCD, a common electrode substrate and an active matrix substrate are disposed and opposite to each other, and a liquid crystal material is interposed between the two substrates. As shown in FIG. 1, a matrix trace composed of a plurality of data lines 12 and a plurality of scan lines 13 is disposed on an active matrix substrate 10. The data lines 12 are arranged on the substrate 10 in a vertical direction and equally-spaced manner. The scan lines 13 are disposed on the substrate 10 in a horizontal direction and equally-spaced manner. The vertical data lines 12 and the horizontal scan lines 13 constitute many display pixels 14 arranged in a matrix. The display pixels constitute a display area 11. The data lines 12 and the scan lines 13 are separated by an insulation layer (not shown). So, the data lines 12 are not connected to the scan lines 13 although the data lines 12 are perpendicular to the scan lines 13 to constitute the display pixels 14. Each display pixel 14 includes a MOSFET (Metal-Oxide Semiconductor Field-Effect Transistor), a liquid crystal capacitor and a storage capacitor (not shown). Each MOSFET has a gate coupled to a corresponding scan line, a source coupled to a corresponding data line, and a drain coupled to the two capacitors. The other ends of the two capacitors are grounded. When the power is transmitted to the TFT-LCD, the MOSFET is controlled by the data lines 12 and the scan lines 13, and the luminance of the corresponding pixel is controlled by the capacitors. In order to enable each display pixel 14 to display the desired image frame, the data lines 12 and the scan lines 13 for driving the MOSFET have to be driven by data line driving units 16, 16' and a scan line driving unit 15.

Owing to the trend of the high resolution LCD, the traces of the data lines 12 and the scan lines 13 are made as possibly thin so that longer and more traces can be accommodated. Thus, the traces may be discontinuous (termination lines) due to the processing technology and other factors. When some traces are discontinuous, the display pixels controlled through the discontinuous traces cannot work normally. A few bad display pixels still can be accepted in the LCD specification, but too many display pixels that cannot work normally make the LCD become a bad product, and a lot of bad products are scrapped accordingly. In view of this, various technologies for repairing traces are disclosed. The frequently used trace repairing technology will be described in the following.

FIG. 2 is a schematic illustration showing a partial structure of a conventional TFT-LCD capable of repairing discontinuous lines. As shown in FIG. 2, a discontinuous data line 28 among the data lines 12 in the substrate 10, which is substantially the same as the active matrix substrate of FIG. 1, is broken into two data lines 28', 28". When the data line driving unit 16 sends out the data signal, only the display pixels controlled by the data line 28' receives the data signal. In order to repair the discontinuous data line 28, the TFT-LCD utilizes a repairing circuit, which is composed of repairing OP amplifiers 24, 24' and repairing traces 26, 27, to make the data line 28" receive the desired data signal, wherein the numbers of OP amplifiers and repairing traces may be modified according to the requirement. The connection points a, c, e, f are not conducted in the normal state, and are treated by laser into the conducted state when the LCD has to be repaired. The nodes b and d are conducted at the beginning of manufacturing the panel so as to avoid the bad product caused by the error of the laser treatment. In addition, the hollow circles represent that the connection points are not conducted, and the solid circles represent that the connection points are conducted.

In this drawing, the scan lines are not shown in order to simplify the drawing, and only the discontinuous data lines have to be repaired in an example. An external test unit (not shown) is provided to test whether the data lines 12 are discontinuous lines. When the discontinuous data line 28 is detected, the discontinuous data line 28 is repaired using the repairing OP amplifier 24 which is chosen because of a smaller RC loading and the nearer distance, and the repairing traces 26, 27. The repairing trace 26 is disposed on an upper peripheral portion of a matrix display area 11, and the disposed repairing trace 27 surrounds the matrix display area. When the discontinuous data line 28 is detected, a near repairing OP amplifier 24 can be connected to the repairing traces 26, 27 to repair the discontinuous data line 28. The data line driving unit 16 first connects the output connection point c of the discontinuous data line 28 to the input terminal repairing trace 26, and the input terminal of the repairing OP amplifier 24 connects to the connection point a of the input terminal repairing trace 26 so as to receive the data signal provided from the data line driving unit 16. Next, the connection point e of the output terminal repairing trace 27 is connected to the data line 28". Thus, the signal on the discontinuous data line 28 of the data line driving unit 16 may be outputted from the repairing OP amplifier 24 to the display pixel corresponding to the data line portion 28". In brief, because the discontinuous data line 28 is broken into two parts, the discontinuous data line 28 only can receive the data signal outputted by the data line driving unit 16 on the data line 28', while the data line 28" cannot receive the desired data signal until the repairing circuit is used. The object of the invention may be achieved according to the above-mentioned transfer path.

In the drawing, only one discontinuous data line 28 is shown. However, there may be several discontinuous data lines, and the number of the discontinuous data lines that can be repaired is restricted by the number of the repairing traces and the repairing OP amplifiers. Although the scan lines are not illustrated in the drawing, the discontinuous scan lines may be repaired in the same manner. In practice, the repairing OP amplifiers 24, 24' are disposed in the data line driving units 16, 16', and the positions thereof in the drawing are arranged in order to simplify the description. In addition, the formation of the connection points a, b, c, d and e may be performed using the laser fuse.

The output terminals of the OP amplifiers are connected to the same output terminal repairing trace 27 at the beginning of manufacturing the panel. The following issues have to be considered.

1. If the discontinuous line is formed at some lateral side, the signal of the discontinuous line is coupled to the input terminal of the OP amplifier near the lateral side using the laser fusing technology, and the OP amplifier generates the repair signal. Thus, the distance from the output terminal of the OP amplifier to the discontinuous line may be shortened, the loading seen from the output terminal may be effectively reduced, and the possibility of repair failure may be decreased.

2. Because the laser fuse needs addition process steps and the problem of yield still exists, the output terminals of the OP amplifiers are connected to the same output terminal repairing trace at the beginning of manufacturing the panel in order to eliminate the cost for the addition process steps and avoid the problem of the reduced yield.

3. If one set of repairing traces is only coupled to one OP amplifier, the more repairing traces, and the far the distance from the visible region of the glass to the glass edge.

Although the above-mentioned repairing technology can really repair the discontinuous data line 28 and thus reduce the number of bad products, the prior art still has some drawbacks. The input terminal f of the OP amplifier 24' is floating because the discontinuous data line 28 does not have to be repaired, so an uncertain output occurs at the output terminal d, and the uncertain output together with the OP amplifier 24 form the output competition. So, the signal on the output terminal repairing trace may be unstable or incorrect, such that the color deviation exists between the display pixels, which receive the output signals of the repairing OP amplifiers.

SUMMARY OF THE INVENTION

It is therefore an object of the invention to provide a TFT-LCD capable of repairing discontinuous lines without color deviation.

Another object of the invention is to provide a high-impedance detecting unit applicable to a TFT-LCD capable of repairing discontinuous lines, so that the high-impedance detecting unit can detect a state of an input terminal of a repairing OP amplifier and control an operation of the repairing OP amplifier.

To achieve the above-identified objects, the invention provides a TFT-LCD (Liquid Crystal Display) capable of repairing discontinuous lines. The LCD has a plurality of data line driving units for driving a plurality of data lines, a plurality of scan line driving units for driving a plurality of scan lines, and a plurality of repairing circuits for repairing discontinuous data lines among the data lines. Each of the repairing circuits includes at least one input terminal repairing trace, a plurality of OP amplifiers, a high-impedance detecting module and at least one output terminal repairing trace. The input terminal repairing trace is connected to the discontinuous data lines of the plurality of data line driving units when the discontinuous data lines are needed to be repaired. Each of the OP amplifiers has an input terminal, an output terminal and a control terminal. The input terminal of one of the OP amplifiers is connected to the input terminal repairing trace when the discontinuous lines are needed to be repaired. The high-impedance detecting module detects whether the input terminals of the OP amplifiers are floating, outputs a control signal to control the output functions of the OP amplifiers, disables the corresponding control signal when the input terminal of the OP amplifier is at a floating state, and enables the corresponding control signal when a voltage is detected at the input terminal of the OP amplifier. The output terminal repairing trace is connected to the output terminal of each of the OP amplifiers. The OP amplifier further receives the control signal of the high-impedance detecting module. An output of the OP amplifier is set to be a high-impedance state when the control signal is disabled. The OP amplifier outputs a signal according to a signal from the input terminal when the control signal is enabled.

DETAILED DESCRIPTION OF THE INVENTION

The feature and operational principle of the invention will be described with reference to the accompanying drawings, wherein the same or similar components are denoted by the same or similar symbols.

Figure 3:
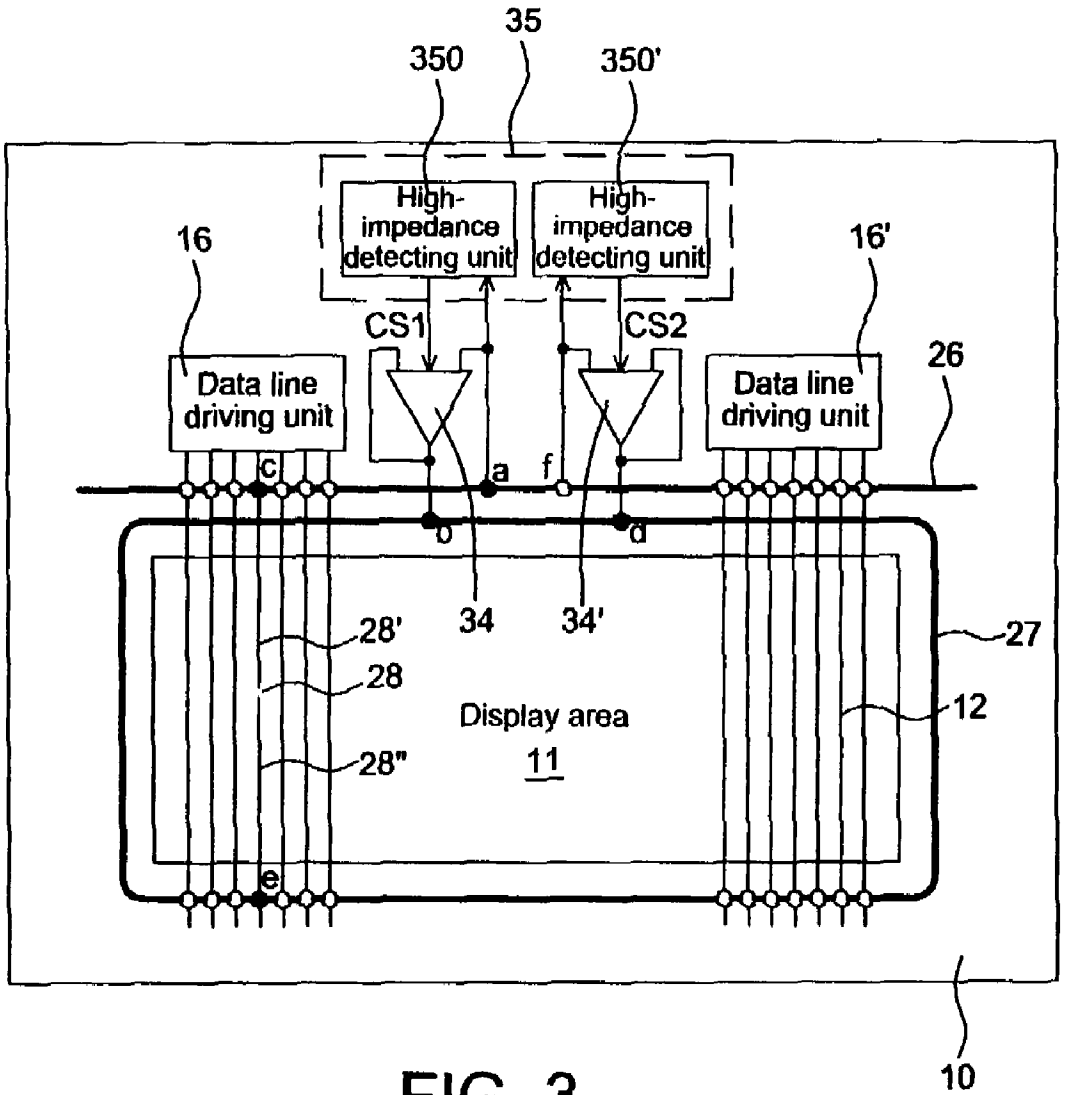
FIG. 3 is a schematic illustration showing a partial structure of a TFT-LCD capable of repairing discontinuous lines according to an embodiment of the invention.

FIG. 3 is a schematic illustration showing a partial structure of a TFT-LCD capable of repairing discontinuous lines according to an embodiment of the invention. As shown in the drawing, the TFT-LCD has an active matrix substrate 10. A plurality of data lines 12 arranged in a vertical direction and equally-spaced manner is disposed on the active matrix substrate 10, and a plurality of scan lines (not shown) arranged in a horizontal direction and equally-spaced manner is disposed on the active matrix substrate 10. The matrix traces formed by crossing the data lines 12 and the scan lines form display pixels arranged in a matrix. The display pixels constitute a display area 11. In order to make each display pixel to display the desired image frame, the data lines 12 and the scan lines are driven by data line driving units 16, 16' and a scan line driving unit (not shown). In the drawing, two data line driving units 16, 16' are shown, but the number of the data line driving units may be decided according to the panel size.

Figure 1:
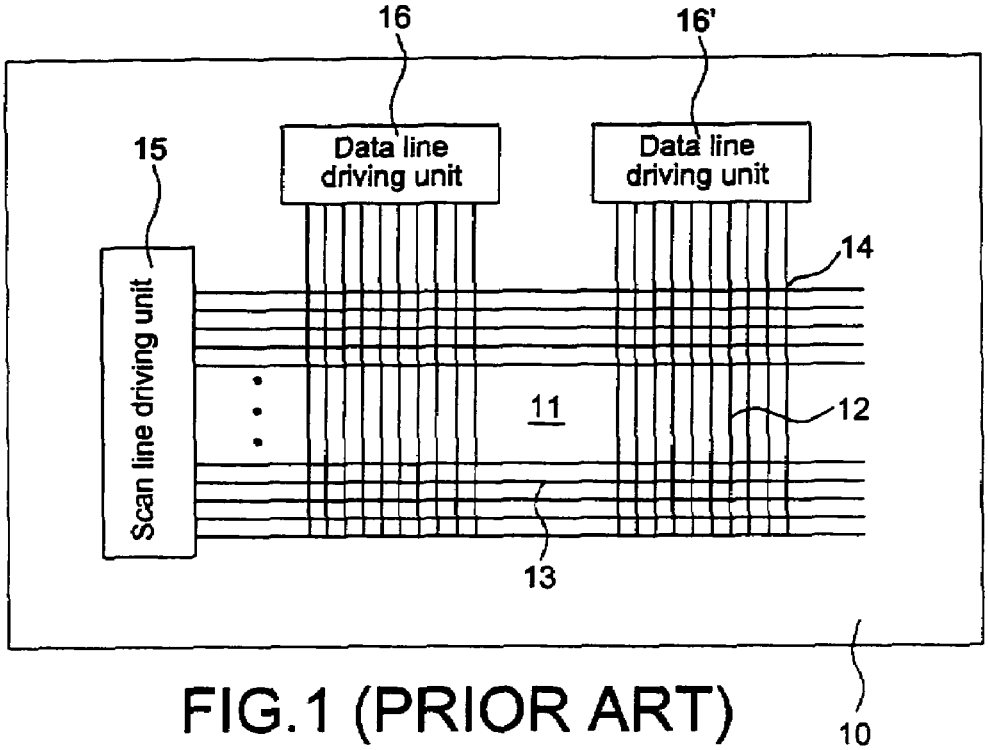
FIG.1 (PRIOR ART)
FIG. 1 is a schematic illustration showing an internal structure of a TFT-LCD.
Figure 2:
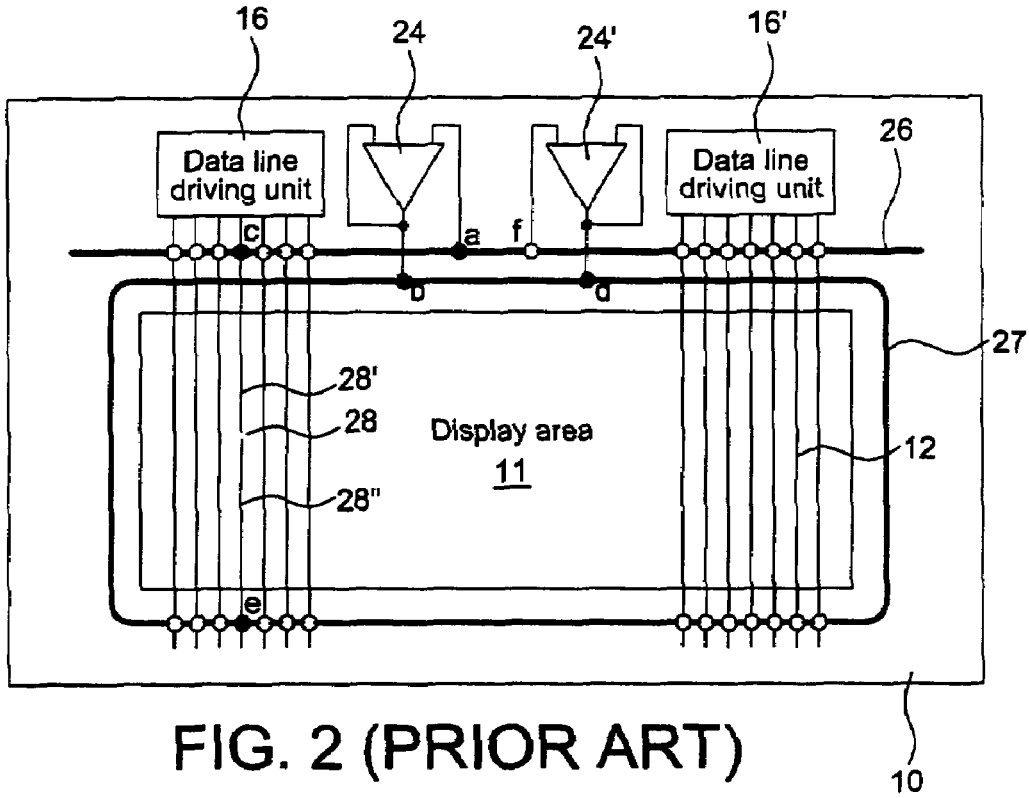
FIG. 2 (PRIOR ART)
FIG. 2 is a schematic illustration showing a partial structure of a conventional TFT-LCD capable of repairing discontinuous lines.

In order to repair the discontinuous scan line (or termination scan line), the TFT-LCD further includes at least one repairing circuit, wherein only one repairing circuit is shown in the embodiment. The repairing circuit includes at least one input terminal repairing trace 26, at least one output terminal repairing trace 27, a plurality of repairing OP amplifiers 34, 34', and a high-impedance detecting module 35. The number of the repairing OP amplifiers is determined according to the number of data line driving units, wherein two repairing OP amplifiers are illustrated in this embodiment. The output terminals of the repairing OP amplifiers 34, 34' are connected to the output terminal repairing trace 27. The high-impedance detecting module 35 detects the state of the input terminal of each of the repairing OP amplifiers 34, 34', and generates a control signal to control the output state thereof. Although the high-impedance detecting module 35 and the repairing OP amplifiers 34, 34' are positioned in the outside of the data line driving units 16, 16', it is preferred that they are disposed in the data line driving units 16, 16'. In this embodiment, the high-impedance detecting module 35 includes two high-impedance detecting units 350, 350'. As shown in FIG. 3, the difference between the TFT-LCD of the invention and the prior art TFT-LCD (FIG. 2) is that the repairing OP amplifier having a control function is used to replace the typical repairing OP amplifier, and the high-impedance detecting module is used to detect the state of the input terminal of the repairing OP amplifier and to control the state of the output terminal of the repairing OP amplifier.

When it is detected that a discontinuous line exists among data lines, the processing method is the same as the prior art and detail descriptions thereof will be omitted. However, because the input terminal f of the repairing OP amplifier 34' in the typical repair method is at a floating state, noises may occur. Thus, the output terminal d of the repairing OP amplifier 34' may output an uncertain voltage, and the uncertain voltage will interfere with the voltage of the output terminal b of the repairing OP amplifier 34, such that the data signal transferred to data line 28" may be incorrect or unstable, thereby causing the image color distortion. Hence, the invention utilizes the high-impedance detecting module 35 to detect whether the repairing OP amplifier has received a signal, and to turn off the output terminal of the repairing OP amplifier when no signal is received (or in the floating state) to avoid influencing the outputs of other repairing OP amplifiers.

As shown in FIG. 3, the high-impedance detecting unit 350 enables an OP control signal CS1 to enable the repairing OP amplifier 34 because the input terminal of the repairing OP amplifier 34 is coupled to the input terminal repairing trace 26. Inversely, the high-impedance detecting unit 350' disables an OP control signal CS2 to disable the repairing OP amplifier 34' because the input terminal of the repairing OP amplifier 34' is floating and not coupled to the input terminal repairing trace 26. Because the repairing OP amplifier 34' is disabled, the output thereof does not influence the output of the repairing OP amplifier 34. Thus, the output competition therebetween can be avoided, and the repairing circuit may operate stably and correctly. Although the above description is made with respect to the repairing of the discontinuous data line, it is also applicable to the repairing of the discontinuous scan line.

Figure 4:
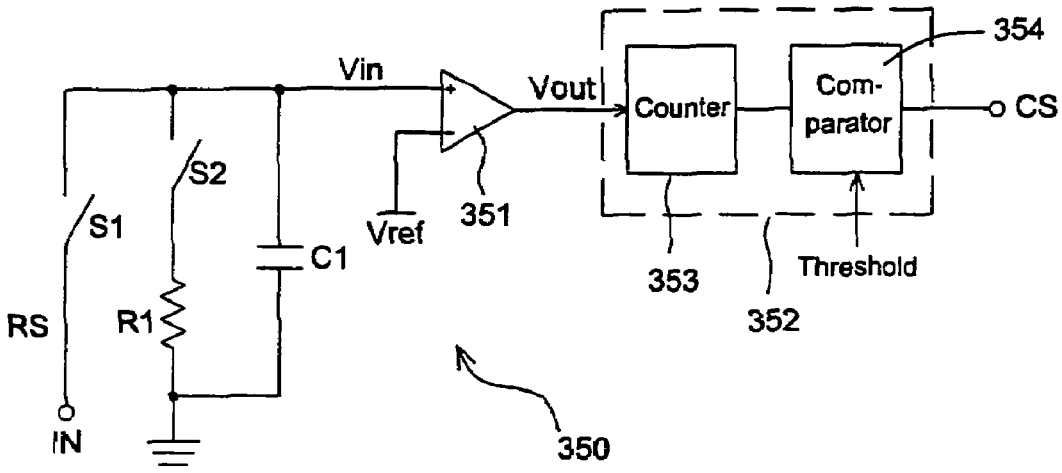
FIG. 4 is a schematic illustration showing a high-impedance detecting unit of the invention.
Figure 5:
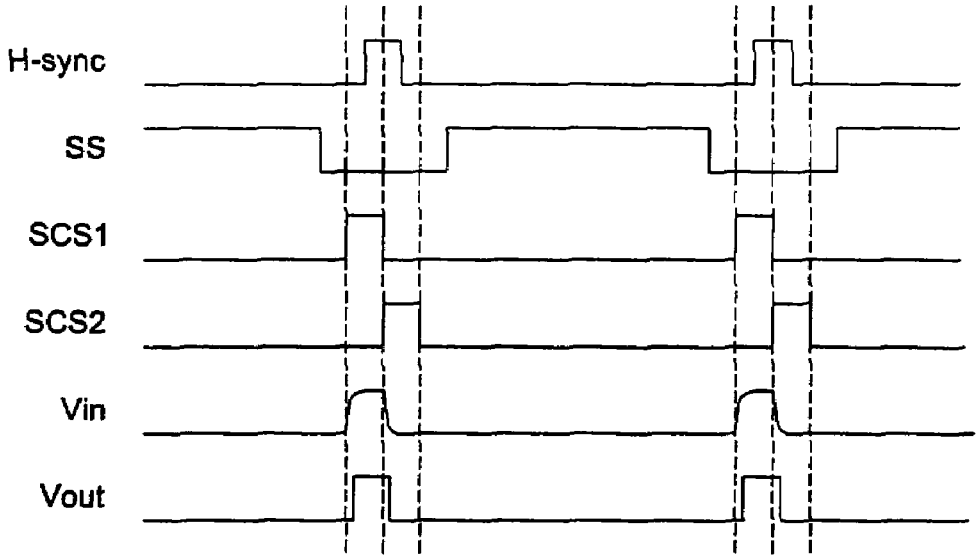
FIG. 5 shows an operation timing chart of the high-impedance detecting unit of FIG. 4.

FIG. 4 is a schematic illustration showing a high-impedance detecting unit of the invention. FIG. 5 shows an operation timing chart of the high-impedance detecting unit of FIG. 4. Referring to FIG. 4, the high-impedance detecting unit 350 includes a first switch S1, a second switch S2, a capacitor C1, a resistor R1, a first comparator 351 and a logic processing unit 352. One terminal of the first switch S1 is coupled to the input terminal of the to-be-detected repairing OP amplifier in order to receive the signal of the input terminal of the repairing OP amplifier as the input signal. The other terminal of the first switch S1 is coupled to an input terminal of the first comparator 351. The input signal charges the capacitor C1 when the first switch S1 is ON and the voltage of the capacitor C1 becomes the input signal Vin of the first comparator 351. When the first switch S1 is OFF and the second switch S2 is ON, the capacitor C1 is discharged through the resistor R1. The first and second switches S1, S2 are controlled by switch control signals SCS1, SCS2 of FIG. 5. In addition, in order to prevent the switching operations of the first and second switches S1, S2 from influencing the signal of the input terminal of the OP amplifier and thus influencing the signal to be sent to the discontinuous data line or the discontinuous scan line, the detecting operation of the high-impedance detecting unit 350 may be performed before the scan line driving unit outputs the scan signal to the scan line.

As shown in FIG. 5, when the horizontal sync signal H-sync is high, it represents that the scan lines are switched. At this time, the scan signal SS at the non-working state of the low level is switched to the working state of the high level, and the high-impedance detecting unit can detect each of the repairing OP amplifiers. When the detection is started, the switch control signal SCS1 turns on the first switch S1, so the input signal charges the capacitor C1. Next, the switch control signal SCS1 turns off the first switch S1, and the switch control signal SCS2 turns on the second switch S2, so the capacitor C1 is discharged through the second switch S2 and resistor R1. The comparator 351 compares the voltage Vin of the capacitor C1 with a reference voltage Vref. When the voltage Vin of the capacitor C1 is higher than the reference voltage Vref, the comparator 351 outputs a comparison signal Vout with a high logic level. When the voltage Vin of the capacitor C1 is lower than the reference voltage Vref, the comparator 351 outputs the comparison signal Vout with a low logic level. That is, when the input terminal of the OP amplifier is coupled to the input terminal repairing trace, the voltage Vin of the capacitor C1 is higher than the reference voltage Vref when the first switch S1 is ON, and the comparison signal Vout is at the high logic level. When the input terminal of the OP amplifier is at the floating state, the voltage Vin of the capacitor C1 is lower than the reference voltage Vref even when the first switch S1 is ON, and the comparison signal Vout is at the low logic level. In addition, the switch control signal SCS2 may also be an inverse signal to the switch control signal SCS1. At this time, the second switch S2 are OFF only when the first switch is on, and the second switch S2 that is ON can discharge the capacitor C1.

Because the comparison signal Vout may cause an error of judgment owing to noises, the comparison signal Vout is acquired by way of repeated test, and the logic processing unit 352 is utilized to generate the OP control signal CS according to the number of times about the comparison signal Vout at the high logic level. The logic processing unit 352 receives the comparison signal Vout, utilizes a counter 353 to count the number of times about the comparison signal Vout at high logic level during the testing period, and utilizes a second comparator 354 to compare the counting value with a threshold value. When the counting value is bigger than the threshold value, the logic processing unit 352 enables the OP control signal CS to enable the corresponding repairing OP amplifier. Inversely, when the counting value is smaller than the threshold value yet after the test ends, the logic processing unit 352 disables the OP control signal CS to disable the output of the corresponding repairing OP amplifier.

The working level of each signal in the high-impedance detecting module 35 may be high or low, the switch control signals SCS1, SCS2 to be provided to the first and second switches S1, S2 may be provided by an internal or external signal generator. The capacitance of the capacitor C1 and the resistance of the resistor R1 may be configured to fit the impedance at the input terminal of the corresponding repairing OP amplifier. On the basis of smooth and correct detection operation of the high-impedance, the design for the ON and OFF periods of switches is free and flexible.

Figure 6:
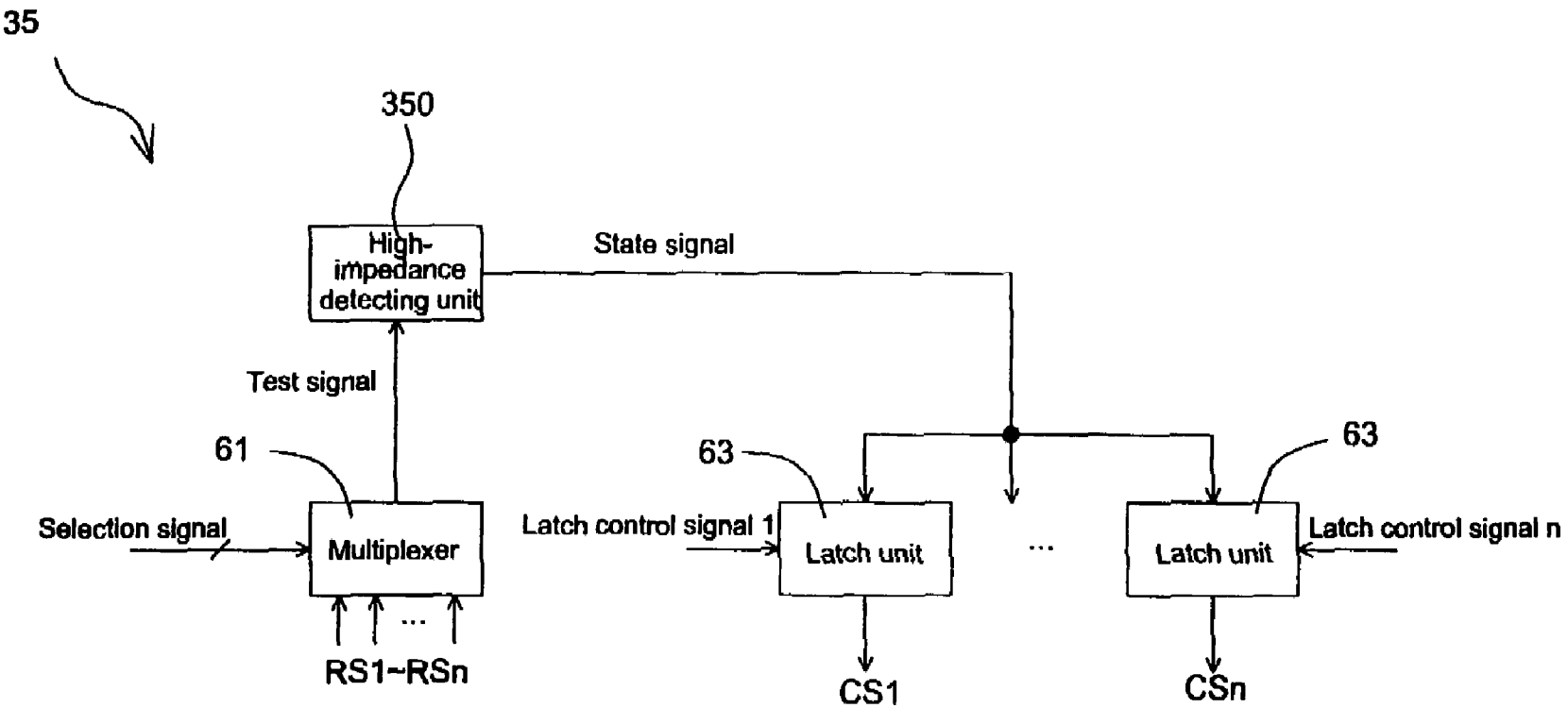
FIG. 6 shows a high-impedance detecting module according to another embodiment of the invention.

FIG. 6 shows a high-impedance detecting module according to another embodiment of the invention. In the architecture of FIG. 3, the high-impedance detecting module 35 includes a plurality of high-impedance detecting units 350, 350'. In the architecture of FIG. 6, however, the high-impedance detecting module 35' only includes a high-impedance detecting unit 350. The high-impedance detecting module 35' includes a multiplexer 61 and a plurality of latch units 63 in addition to the high-impedance detecting unit 350. Because the high-impedance detecting module 35' only utilizes one high-impedance detecting unit 350 to respectively detect the signals RS1 to RSn at the input terminals of the plurality of repairing OP amplifiers, the multiplexer 61 has to be used to switch and select the signal at the input terminal of the single repairing OP amplifier as the test signal for detection. Furthermore, the plurality of latch units 63 has to be used to sample and hold (S/H) the corresponding test result outputted from the high-impedance detecting unit 350. Because the single detecting unit has to detect a plurality of repairing OP amplifiers alternatively, the detection period increases with the increase of the number of repairing OP amplifiers, but the detection behavior is still the same.

The multiplexer 61 receives the signals RS1 to RSn at the input terminals of the plurality of repairing OP amplifiers, selects a signal as the test signal according to a selection signal, and outputs the test signal to the high-impedance detecting unit 350. The high-impedance detecting unit 350 checks the state of the test signal, and outputs a state signal to the plurality of latch units 63. The latch units 63 sample and hold the corresponding test result according to different latch control signal 1 to latch control signal n, and output the latched signals to the corresponding repairing OP amplifiers. That is, when the multiplexer 61 selects the first repairing OP amplifier to detect, the first latch unit 63 is controlled to sample and hold the output signal of the high-impedance detecting unit 350.

While certain exemplary embodiments have been described and shown in the accompanying drawings, it is to be understood that such embodiments are merely illustrative of and not restrictive on the broad invention, and that this invention not be limited to the specific construction and arrangement shown and described, since various other modifications may occur to those ordinarily skilled in the art. For instance, the OP amplifiers may be replaced by a component having a control terminal, an input terminal and an output terminal, wherein the output at the output terminal does not affect the input at the input terminal. The high-impedance detecting units may be disposed inside or outside the data or scan line driving unit, and the numbers of the OP amplifiers, the input terminals and the output terminal repairing traces do not have to be the same. In addition, the invention can be applied in the TFT-LCD, a display, which has a plurality of scan lines and drive lines to constitute many light-emitting pixels and is formed using semiconductor manufacturing processes, or electrical devices.

What is claimed is:

1. A TFT-LCD (Thin Film Transistor Liquid Crystal Display) capable of repairing discontinuous lines, the LCD having at least one data line driving unit for driving a plurality of data lines, at least one scan line driving unit for driving a plurality of scan lines, and a plurality of repairing circuit units for repairing discontinuous data lines among the data lines, each of the repairing circuit units comprising:

at least one input terminal repairing trace, wherein when there is at least a discontinuous data line needed to be repaired, one of the input terminal repairing traces is connected to one of the discontinuous data lines;

a plurality of repairing OP amplifiers, each including an input terminal, an output terminal and a control terminal, the input terminal of one of the repairing OP amplifiers is connected to the input terminal repairing trace connected to one of the discontinuous data lines;

a high-impedance detecting module for detecting a voltage at the input terminal of each of the repairing OP amplifiers and generating an OP control signal for each of the repairing OP amplifiers, the OP control signal being disabled when the input terminal of the corresponding repairing OP amplifier is floating, otherwise the OP control signal being enabled; and at least one output terminal repairing trace connected to the output terminal of each of the repairing OP amplifiers;

wherein each of the repairing OP amplifiers further receives the corresponding OP control signal of the high-impedance detecting module and sets its output terminal to a high-impedance state when the corresponding OP control signal is disabled, and the OP amplifier outputs a signal according to the voltage at the input terminal when the OP control signal is enabled.

2. The TFT-LCD according to claim 1, wherein the high-impedance detecting module comprises a plurality of high-impedance detecting units for respectively receiving the voltage at the input terminal of each of the repairing OP amplifiers as a test signal, detecting whether the test signal is floating, and respectively enabling or disabling the OP control signal.

3. The TFT-LCD according to claim 2, wherein the high-impedance detecting unit detects the voltage of the input signal when a horizontal sync signal is enabled.

4. The TFT-LCD according to claim 2, wherein the high-impedance detecting unit comprises:

a first switch having a first terminal, which is coupled to the test signal, and a second terminal, the first switch being controlled by a first switch control signal;

a resistor having a first terminal, which is grounded, and a second terminal;

a second switch having a first terminal and a second terminal, the second switch being controlled by a second switch control signal, the first terminal of the second switch being coupled to the second terminal of the resistor, the second terminal of the second switch being coupled to the second terminal of the first switch;

a capacitor having a first terminal, which is grounded, and a second terminal, which is coupled to the second terminal of the first switch;

a comparator for comparing a voltage at the second terminal of the first switch with a reference voltage, and outputting a comparison signal; and a logic processing unit for receiving the comparison signal and outputting the test result signal according to a voltage of the comparison signal, wherein the first switch is first turned on for a period of time and then turned off and then the second switch is turned on for a period of time in a repeated manner for a predetermined period.

5. The TFT-LCD according to claim 4, wherein the second switch control signal is an inverse signal to the first switch control signal.

6. The TFT-LCD according to claim 4, wherein the second switch is ON when the first switch is OFF, such that the capacitor discharges through the second switch.

7. The TFT-LCD according to claim 4, wherein the logic processing unit comprises:

a counter for counting the number of times when the comparison signal is at a first state; and a comparator for comparing a counting value of the counter with a threshold value, wherein the test result signal is enabled when the counting value is higher than the threshold value, or otherwise the test result signal is disabled.

8. The TFT-LCD according to claim 1, wherein the high-impedance detecting module comprises:

a multiplexer for receiving the voltages at the input terminals of the plurality of repairing OP amplifiers, and selecting one voltage as a test signal for output according to a selection signal;

a high-impedance detecting unit for receiving the test signal, detecting whether the test signal is floating, and then generating a test result signal; and a plurality of latch circuits for simultaneously receiving the test result signal of the high-impedance detecting unit, sampling and holding the test result signal according to a corresponding latch signal, and outputting the corresponding OP control signal;

wherein the test result signal is disabled when the test signal is floating, or otherwise the test result signal is enabled.

9. A TFT-LCD (Thin Film Transistor Liquid Crystal Display) capable of repairing discontinuous lines, the LCD having at least one scan line driving unit for driving a plurality of scan lines, at least one data line driving unit for driving a plurality of data lines, and a plurality of repairing circuits for repairing discontinuous scan lines among the scan lines, each of the repairing circuits comprising:

at least one input terminal repairing trace, wherein when there is at least a discontinuous scan line needed to be repaired, one of the input terminal repairing traces is connected to one of the discontinuous scan lines;

a plurality of repairing OP amplifiers each having an input terminal, an output terminal and a control terminal, the input terminal of one of the repairing OP amplifiers is connected to the input terminal repairing trace connected to one of the discontinuous scan lines;

a high-impedance detecting module for detecting a voltage at the input terminal of each of the repairing OP amplifiers and generating an OP control signal for each of the repairing OP amplifiers, the OP control signal being disabled when the input terminal of the corresponding repairing OP amplifier is floating, otherwise the OP control signal being enabled; and at least one output terminal repairing trace connected to the output terminal of each of the repairing OP amplifiers, wherein each of the repairing OP amplifiers further receives the corresponding OP control signal of the high-impedance detecting module and sets its output terminal to a high-impedance state when the corresponding OP control signal is disabled, and the OP amplifier outputs a signal according to the voltage at the input terminal when the OP control signal is enabled.

10. The TFT-LCD according to claim 9, wherein the high-impedance detecting module comprises a plurality of high-impedance detecting units for respectively receiving the signal at the input terminal of each of the repairing OP amplifiers as a test signal, detecting whether the test signal is floating, and respectively enabling or disabling the OP control signal.

11. The TFT-LCD according to claim 10, wherein the high-impedance detecting unit detects the voltage of the input signal when a horizontal sync signal is enabled.

12. The TFT-LCD according to claim 10, wherein the high-impedance detecting unit comprises:

a first switch having a first terminal, which is coupled to the test signal, and a second terminal, the first switch being controlled by a first switch control signal;

a resistor having a first terminal, which is grounded, and a second terminal;

a second switch having a first terminal and a second terminal, the second switch being controlled by a second switch control signal, the first terminal of the second switch being coupled to the second terminal of the resistor, the second terminal of the second switch being coupled to the second terminal of the first switch;

a capacitor having a first terminal, which is grounded, and a second terminal, which is coupled to the second terminal of the first switch;

a comparator for comparing a voltage at the second terminal of the first switch with a reference voltage, and outputting a comparison signal; and a logic processing unit for receiving the comparison signal and outputting the OP control signal according to a voltage of the comparison signal, wherein the first switch is first turned on for a period of time and then turned off and then the second switch is turned on for a period of time in a repeated manner for a predetermined period.

13. The TFT-LCD according to claim 12, wherein the second switch control signal is an inverse signal to the first switch control signal.

14. The TFT-LCD according to claim 12, wherein the second switch is ON when the first switch is OFF, such that the capacitor discharges through the second switch.

15. The TFT-LCD according to claim 12, wherein the logic processing unit comprises:

a counter for counting the number of times when the comparison signal is at a first state; and a comparator for comparing a counting value of the counter with a threshold value, wherein the OP control signal is enabled when the counting value is higher than the threshold value, or otherwise the OP control signal is disabled.

16. The TFT-LCD according to claim 10, wherein the high-impedance detecting module comprises:

a multiplexer for receiving the voltages at the input terminals of the plurality of repairing OP amplifiers, and selecting one voltage as a test signal for output according to a selection signal;

a high-impedance detecting unit for receiving the test signal, detecting whether the test signal is floating, and then generating a test result signal; and a plurality of latch circuits for simultaneously receiving the test result signal of the high-impedance detecting unit, sampling and holding the test result signal according to a corresponding latch signal, and outputting the corresponding OP control signal;

wherein the test result signal is disabled when the test signal is floating, or otherwise the test result signal is enabled.

17. A high-impedance detecting unit for detecting whether a connection point has a high-impedance, the high-impedance detecting unit comprising:

a first switch being controlled by a first switch control signal and having a first terminal and a second terminal, the first terminal being coupled to the connection point;

a resistor having a first terminal and a second terminal, the first terminal being grounded;

a second switch being controlled by a second switch control signal and having a first terminal and a second terminal, the first terminal of the second switch being coupled to the second terminal of the resistor, the second terminal of the second switch being coupled to the second terminal of the first switch;

a capacitor having a first terminal, which is grounded, and a second terminal, which is coupled to the second terminal of the first switch;

a comparator for comparing a voltage at the second terminal of the first switch with a reference voltage, and outputting a comparison signal; and a logic processing unit for receiving the comparison signal, and enabling or disabling a control signal according to a voltage of the comparison signal;

wherein the first switch is first turned on for a period of time and then turned off and then the second switch is turned on for a period of time in a repeated manner.

18. The high-impedance detecting unit according to claim 17, wherein the second switch control signal is an inverse signal to the first switch control signal.

19. The high-impedance detecting unit according to claim 17, wherein the second switch is ON when the first switch is OFF, such that the capacitor discharges through the second switch.

20. The high-impedance detecting unit according to claim 17, wherein the logic processing unit comprises:

a counter for counting the number of times when the comparison signal is at a first state; and a comparator for comparing a counting value of the counter with a threshold value, wherein the control signal is enabled when the counting value is higher than the threshold value, or otherwise the control signal is disabled.

* * * * *